US006688913B2

(12) United States Patent
Li

(10) Patent No.: US 6,688,913 B2
(45) Date of Patent: Feb. 10, 2004

(54) CONNECTOR ASSEMBLY STRUCTURE

(76) Inventor: Chun-De Li, 2F, No. 5, Alley 3, Lane 147, Pateh Rd., Sec. 2, Panchiao City, Taipei Hsien (TW)

( * ) Notice: Subject to any disclaimer, the term of this patent is extended or adjusted under 35 U.S.C. 154(b) by 0 days.

(21) Appl. No.: 10/123,239

(22) Filed: Apr. 17, 2002

(65) Prior Publication Data

US 2003/0199194 A1 Oct. 23, 2003

(51) Int. Cl.[7] ..... H01R 13/648
(52) U.S. Cl. ..... 439/541.5; 439/607
(58) Field of Search ..... 439/607–610, 439/541.5

(56) References Cited

U.S. PATENT DOCUMENTS 6,086,429 A * 7/2000 Wu ..... 439/607
6,168,467 B1 * 1/2001 Chiou ..... 439/607
6,179,661 B1 * 1/2001 Chiou ..... 439/607
6,210,226 B1 * 4/2001 Zhu et al. ..... 439/607

* cited by examiner

*Primary Examiner*—Gary Paumen
(74) *Attorney, Agent, or Firm*—Bacon & Thomas, PLLC

(57) ABSTRACT

The present invention relates to a connector assembly structure consisting of a frame, with the said frame capable of accommodating the installation of at least one connector, and a shielding plate ensconced around the said connector. The said shielding plate has at least one latch tab and one coupling tab, while the said frame has latch and coupling slots that match the said latch and coupling tabs and enables the respective insertion of the said latch and coupling tabs into the said latch and coupling slots to thereby the mount of the said connectors onto the said frame.

12 Claims, 2 Drawing Sheets

CONNECTOR ASSEMBLY STRUCTURE

BACKGROUND OF THE INVENTION

1) Field of the Invention

The invention herein relates to a connector assembly structure.

2) Description of the Prior Art

Referring to FIG. 1, a conventional connector assembly structure consists of a base 1, the said base 1 having recess 10 disposed in one side; at least one first fitting component 12 inside the said recess 10; and at least one connector socket 2, the said connector socket 2 having ground pin 20 at one end surface and a second fitting component 22 at its other end surface, with a projecting extremity 24 on one side of the connector socket 2. During assembly, the second fitting component 22 of the said connector socket 2 is inserted into the first fitting component 12 of the base 1, the base 1 is then installed onto a mainboard, thereby enabling the transfer of signal input and output through the projecting extremity 24 of the connector socket 2.

To prevent electromagnetic radiation from the said connector socket 2, a metal plate 3 is situated on the surface of the said connector socket 2 that faces rearward in the direction of the base 1. The said metal plate 3 has a pin 30 at each of its two sides and an opening 32 respectively aligned with the position of the connector socket 2. The said base 1 has slots 24 formed in alignment with the position of the said pins 30. When the said pins 30 are inserted into the said slots 24, the said metal plate 3 becomes mounted onto the said base 1 such that the said connector socket 2 projects out from said metal plate 3.

However, if the quantity of connectors 2 on the said base 1 is increased or decreased, a new mold must be created to fabricate another base and, furthermore, another mold is required for a new metal plate to thereby accommodate the installation of the said connectors. As such, production cost is significantly higher.

Additionally, if more connectors 2 are to be positioned on the new base, then a new metal plate is needed to match the new base, specifically to conform with the change in length of the new base. Furthermore, a greater plurality of openings must be fabricated in the said metal plate to enable the said connectors 2 to protrude outside. Since such a shielding plate consists of a very thin sheet metal, structural strength is undermined if too many holes are formed in it and, furthermore, structural durability becomes insufficient if its length is excessive, with the new metal plate readily bent and deformed as a result.

As such, before the new metal plate is fabricated, it is easily damaged beyond usability due to shipping and impact, resulting in component wastage or the new metal plate cannot be inserted onto the said base in a single attempt because too many openings for connectors have been formed it, with the consequent assembly difficulties increasing production time. Therefore, if a said metal plate having sufficient structural strength can be developed at minimum molding cost and, furthermore, that facilitates the production operation of the said connector assembly structure, this would be welcomed by manufacturers.

SUMMARY OF THE INVENTION

The objective of the invention herein is to provide a connector assembly structure consisting of a frame, with the said frame capable of accommodating the installation of at least one connector, and a shielding plate ensconced around the said connector. The said shielding plate has at least one latch tab and one coupling tab, while the said frame has latch and coupling slots that match the said latch and coupling tabs and enables the respective insertion of the said latch and coupling tabs into the said latch and coupling slots to thereby the mount of the said connectors onto the said frame.

DETAILED DESCRIPTION OF THE INVENTION

Figure 1:
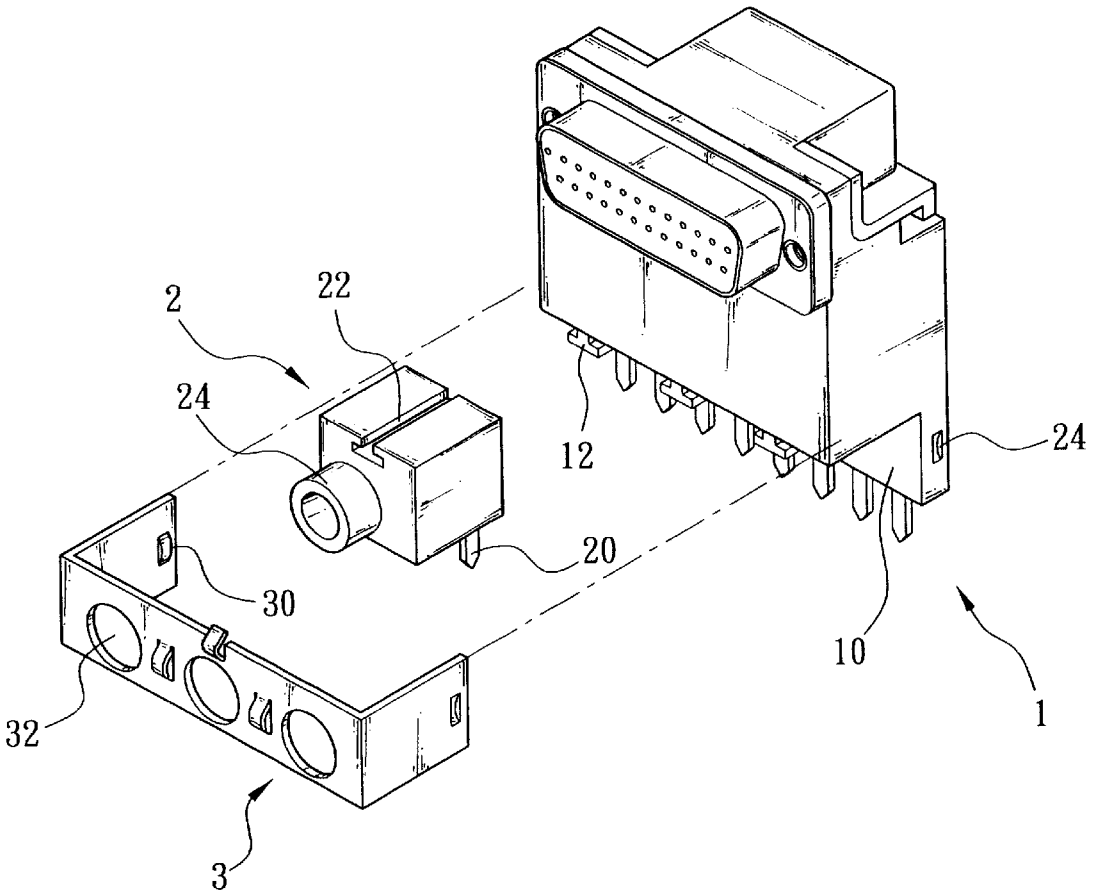
FIG. 1 (Prior Art)
FIG. 1 is an exploded drawing of the prior art.
Figure 2:
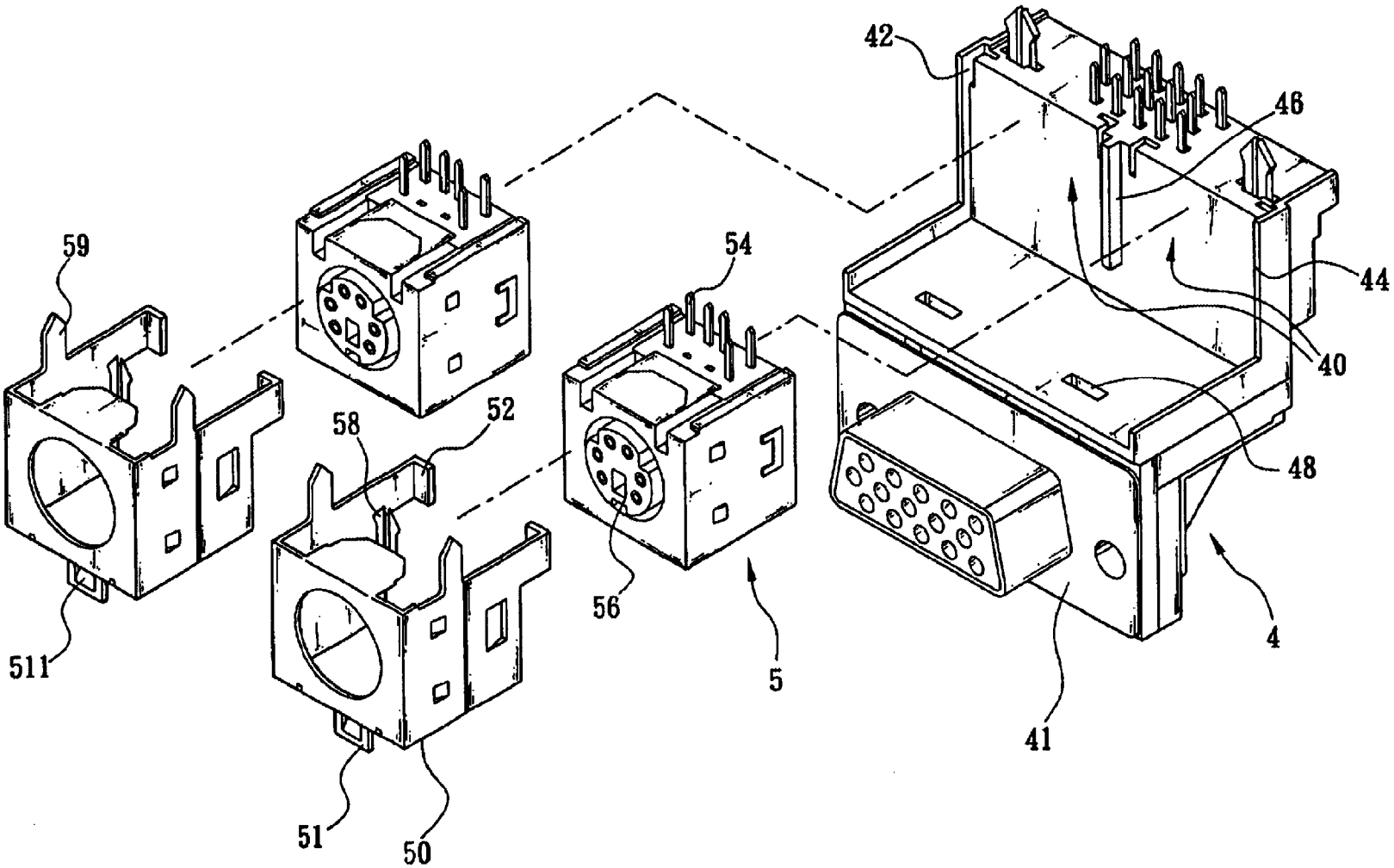
FIG. 2 is an exploded drawing of the invention herein.

Referring to FIG. 2, the connector assembly structure of the invention herein consists of a frame 4, the said frame 4 having at least two installation sections 40, wherein at least one connector 5 is disposed on at least one installation section 40, the said connector 5 having an appropriately situated plurality of pins 54 and a socket section 56 at another suitable position; a shielding plate 50 ensconces the said connectors 5 with the pins 54 and the socket section 56 of the said connectors 5 protruding out of the said shielding plate 50 such that the said pins 54 are connectable to an appropriately positioned electronic device and the said socket section 56 provides for interfacing to another matching connector; the said shielding plate 50 has at least one latch tab 52 suitably positioned facing the said frame 4 as well as at least one coupling tab 51 suitably situated at another position; the said installation section 40 has a latch slot 42 positioned on it that is aligned with the said latch tab 52 as well as a coupling slot 48 that is aligned with the said coupling tab 51 such that the respective insertion of the said latch tabs 52 into the said latch slots 42 and the respective insertion of the said coupling tabs 51 into the said coupling slots 48 enables the mounting of the said connectors 5 onto the said frame 4 (The structure of the connectors 5 assembled onto the said frame 4 and its installation sections 40 are of conventional technology and, therefore, shall not be further elaborated).

In the most preferred embodiment of the invention herein, the said installation sections 40 have at least one flange 44 laterally disposed at the said connectors 5 such that when the said connectors 5 are assembled to the said installation sections 40, the said flanges 44 guide the locating of the said connectors 5 and thereby enable the rapid and convenient placement of the connectors 5 onto the said installation sections 40.

In the said embodiment, the said installation sections 40 have a partition plate 46 disposed between the said connectors 5 such that when the said connectors 5 are assembled to the said installation sections 40, the said partition plate 46 guides the locating as well as the placement of the said connectors 5 and is utilized to keep the said connectors 5 separated.

In the said embodiment, the said latch tabs 52 are L-shaped members, the two tips of which straddle one face of the socket section 56 towards the proximity of the pins 54 and into the constraining openings of the latch slots 42, thereby enabling their respective insertion and engagement into the said constraining openings such that they fix the connectors 5 onto the said frame 4 and, furthermore, since the said members are clamped around the said frame 4, the said shielding plate 50 does not sway left and right; the said coupling tab 51 is a thin member at one end of the said shielding plate 50 situated over one face of the socket section 56 towards the said pins 54 at the rear, with a catch element 511 disposed at an appropriate position; each said coupling tab 51 serves as a thin member mated to an insertion hole 48 on the said frame 4 that enables the respective fitting of the said thin members into the said insertion holes 48 such that they fix the connectors 5 onto the said frame 4 and, furthermore, the said shielding plate 50 cannot be dislodged from the said frame 4 because the said catch elements are retained in the said insertion holes.

The said shielding plate 50 has mounting feet 58 appropriately situated at the side facing the said pins 54 and when the said connectors 5 are inserted into the predetermined installation position of a circuit board, the said mounting feet 58 are at the same time inserted into the said circuit board at the corresponding designated installation position, the said mounting feet 58 enabling the attachment of the connectors 5 to the said circuit board.

The said shielding plate 50 has at least one soldering lug 59 situated at each of the two ends facing the said pins 54 and when the said connectors 5 are inserted into the predetermined installation position of the said circuit board, the said soldering lugs 59 are at the same time inserted into the said circuit board at the corresponding designated installation position such that the soldering lugs 59 are grounded to the said circuit board to neutralize electromagnetic waves generated by the connectors 5, thereby preventing electromagnetic wave radiation and, furthermore, anchoring the said connectors 5 by means of the said soldering lugs 59.

In the invention herein, the said connectors 5 can be shielded double mini DIN connectors, USB B-series female sockets, or USB 1394 jacks.

Given the said structural component assembly, the said shielding plate 50 ensconcing the said connectors 5 is such that the number of openings formed in the said shielding plate 50 is significantly reduced and, furthermore, a fewer parts are required to conjoin it to the said frame 4, thereby enabling faster insertion onto the said frame 4 and, consequently, increasing the frame 4 installation sections 40 or decreasing the quantity of connectors 5 only requires a frame 4 that meets the requirements of the respective quantity of connectors 5 to be installed which thereby facilitates assembly, simplifies and shortens assembly time and, furthermore, lowers shielding plate 50 molding costs, while also providing for the adequate structural strength of the said shielding plate 50.

While the invention has been described by means of specific embodiments, numerous modifications and variations could be made thereto by those skilled in the art without departing from the scope and spirit of the invention set fort.

What is claimed is:

1. A connector assembly structure comprising:

at least one connector, the connector having a plurality of pins at one position, a socket section at another position and a shielding plate that wraps the connector with the pins and the socket section protruding out of the shielding plate such that the pins are connectable to an electronic device and the socket section provides an interface to another corresponding connector, the shielding plate has at least one latch tab situated at one position as well as at least one coupling tab situated at another position; and a frame having at least two installation sections with the connector disposed on at least one of the installation sections, each of the installation sections having a latch slot positioned thereon that is aligned with the latch tab as well as a coupling slot that is aligned with the coupling tab such that respective insertion of the latch tab into the latch slot and respective insertion of the coupling tab into the coupling slot securely mounts the connector onto the frame.

2. The connector assembly structure as claimed in claim 1, wherein the installation sections have at least one flange laterally disposed at the connectors.

3. The connector assembly structure as claimed in claim 1, wherein the installation sections have a partition plate disposed therebetween.

4. The connector assembly structure as claimed in claim 1, wherein the at least one latch tab is plural in number and includes two tips straddled over one face of the socket section towards the proximity of the pins.

5. The connector assembly structure as claimed in claim 1, wherein the coupling tab is at one end of the shielding plate that is situated over one face of the socket section towards the pins at a rear thereof.

6. The connector assembly as claimed in claim 1, wherein the shielding plate has mounting feet situated at the side facing the pins.

7. The connector assembly structure as claimed in claim 1, wherein the shielding plate has at least one soldering lug situated at each of the two ends facing the pins.

8. The connector assembly structure as claimed in claim 1, wherein the latch tabs are L-shaped members that are capable of engagement into constraining openings of the latch slots, thereby enabling respective insertion into the constraining opening and the shielding plate locks to the frame.

9. The connector assembly structure as claimed in claim 1, wherein the coupling tab is a thin member with a catch element disposed at an appropriate position, the coupling tab serves as a thin member inserted to an insertion hole that enables the respective fitting of the thin member into the insertion hole such that the connector is fixed onto the frame and the shielding plate cannot be dislodged from the frame since the catch elements are retained in the insertion holes.

10. The connector assembly structure as claimed in claim 1, wherein the connector is a shielded double mini DIN connector.

11. The connector assembly structure as claimed in claim 1, wherein the connector is a USB B-series female socket.

12. The connector assembly structure as claimed in claim 1, wherein the connector is a USB 1394 jack.

* * * * *